US010969161B2

(12) United States Patent
Zhang et al.

(10) Patent No.: US 10,969,161 B2
(45) Date of Patent: Apr. 6, 2021

(54) REFRIGERATOR

(71) Applicant: HAIER SMART HOME CO., LTD., Qingdao (CN)

(72) Inventors: Kui Zhang, Qingdao (CN); Falin Yang, Qingdao (CN); Guangrui Wu, Qingdao (CN); Jun Nie, Qingdao (CN); Jian Zhang, Qingdao (CN)

(73) Assignee: HAIER SMART HOME CO., LTD., Qingdao (CN)

( * ) Notice: Subject to any disclaimer, the term of this patent is extended or adjusted under 35 U.S.C. 154(b) by 0 days.

(21) Appl. No.: 17/040,488

(22) PCT Filed: Oct. 15, 2019

(86) PCT No.: PCT/CN2019/111169
§ 371 (c)(1),
(2) Date: Sep. 22, 2020

(87) PCT Pub. No.: WO2020/103608
PCT Pub. Date: May 28, 2020

(65) Prior Publication Data

US 2021/0025650 A1 Jan. 28, 2021

(30) Foreign Application Priority Data

Nov. 20, 2018 (CN) ..... 201811384566.3

(51) Int. Cl.
*F25D 25/02* (2006.01)
*F25D 23/02* (2006.01)
(Continued)

(52) U.S. Cl.
CPC ..... *F25D 25/025* (2013.01); *A47B 88/41* (2017.01); *A47B 88/44* (2017.01); *A47B 88/477* (2017.01); *F25D 23/02* (2013.01)

(58) Field of Classification Search
CPC ..... F25D 25/025; F25D 23/02; A47B 88/41; A47B 88/44; A47B 88/477; A47B 88/75; A47B 96/16
See application file for complete search history.

(56) References Cited

U.S. PATENT DOCUMENTS 7,712,852 B2 * 5/2010 Choi ..... A47B 88/49 312/402
9,638,459 B2 * 5/2017 Choi ..... F25D 25/025
(Continued)

FOREIGN PATENT DOCUMENTS

CN 1940438 A 4/2007
CN 1940438 B 6/2010
(Continued)

*Primary Examiner* — Kimberley S Wright
(74) *Attorney, Agent, or Firm* — Cheng-Ju Chiang

(57) ABSTRACT

The present invention discloses a refrigerator, comprising a drawer assembly which comprises a first drawer, a first slide rail assembly and a second drawer located below the first drawer, a first recess being disposed on one of the second drawer and the first drawer, and a protrusion being disposed on the other; the first slide rail assembly comprises a guide rail connected in to the cabinet and a slideway disposed on the first drawer, the front end of the slideway being provided with an inclined portion extending obliquely upward from rear to front.

8 Claims, 4 Drawing Sheets

(51) Int. Cl.

| | |
|---|---|
| ***A47B 88/41*** | (2017.01) |
| ***A47B 88/44*** | (2017.01) |
| ***A47B 88/477*** | (2017.01) |

(56) References Cited

U.S. PATENT DOCUMENTS

| | | | | |
|---|---|---|---|---|
| 9,677,807 | B2 * | 6/2017 | Shin | A47B 88/473 |
| 10,551,113 | B1 * | 2/2020 | Wantland | A47B 88/49 |
| 10,563,912 | B1 * | 2/2020 | Kumar | A47B 88/417 |
| 2010/0090574 | A1 * | 4/2010 | Lim | F25D 25/025 312/404 |
| 2010/0219730 | A1 * | 9/2010 | Watts | F25D 25/025 312/404 |
| 2016/0178274 | A1 | 6/2016 | Shin | |
| 2016/0209107 | A1 | 7/2016 | Choi et al. | |
| 2018/0100690 | A1 * | 4/2018 | Gatter | F25D 23/02 |

FOREIGN PATENT DOCUMENTS

| | | | |
|---|---|---|---|
| CN | 102954658 | A | 3/2013 |
| CN | 102954658 | B | 9/2016 |
| CN | 107062780 | A | 8/2017 |
| CN | 109708418 | A | 5/2019 |
| CN | 209588502 | U | 11/2019 |

* cited by examiner

REFRIGERATOR

CROSS REFERENCE TO RELATED APPLICATIONS

The present application is a 35 U.S.C. § 371 National Phase conversion of International (PCT) Patent Application No. PCT/CN2019/111169, filed on Oct. 15, 2019, which claims benefit of Chinese patent application No. 201811384566.3 filed on Nov. 20, 2018, the disclosure of which is incorporated by reference herein. The PCT International Patent Application was filed and published in Chinese.

TECHNICAL FIELD

The present invention relates to the field of refrigeration devices, and particularly to a refrigerator convenient for use by a user.

BACKGROUND

Freezing compartments in conventional refrigerators mostly employ a drawer-type storage manner, namely, a plurality of drawers are disposed at an interval in a vertical direction in the freezing compartment to store different foods in a classified manner and prevent the transferring of door between foods.

When a refrigerator employs a draw-type door, only one door body drawable in a front-rear direction is usually disposed, and meanwhile a plurality of drawers are disposed. To facilitate the user to access articles, the door body is linked with at least one of the drawers.

The draw-type doors of some conventional refrigerators are provided with a connector connected with one of the plurality of drawers so that the drawer is linked with the draw-type door such that all drawers can be opened at one time; however, after all drawers are opened at one time, the drawer needs to be manually separated from the draw-type door so that articles in other drawers under said drawer can be viewed and accessed, which is cumbersome and complex in structure.

In view of the above, it is necessary to provide a novel refrigerator to address the above problems.

SUMMARY

An object of the present invention is to provide a refrigerator convenient for use by a user.

To achieve the above object, the present invention employs the following technical solutions:

A refrigerator, comprising a cabinet having a storage chamber, a door body slideably connected to the cabinet in a front-rear direction to open and close the storage chamber, and a drawer assembly located in the storage chamber, the drawer assembly comprising a first drawer, a first slide rail assembly slideably connecting the first drawer to an interior of the cabinet, a second drawer slideably connected to the interior of the cabinet and located below the first drawer, the second drawer being capable of moving forward along with the door body, a first recess is disposed at a front end of one of an upper surface of opposed sidewalls of the second drawer and an underside of the first drawer, and a protrusion engaging with the first recess is disposed on the other; the first slide rail assembly comprises a guide rail connected in to the interior of the cabinet and having a slide groove, a slideway disposed on the first drawer, a front roller connected to a front end of the guide rail and engaging with the slideway, and a rear roller connected to a rear end of the slideway and engaging with the slide groove, the front end of the slideway being provided with an inclined portion extending obliquely upward from rear to front.

Advantageous effects of the present invention are as follows: the first recess is disposed on one of the second drawer and first drawer of the refrigerator according to the present invention, and the protrusion engaging with the first recess is disposed on the other; meanwhile, the inclined portion is disposed at the front end of the slideway; while the door body is pulled forward so that the second drawer brings the first drawer to move forward synchronously, the front roller moves along the inclined portion, and the first drawer synchronously moves upward while moving forward, so that the protrusion gradually disengages from the first recess; after the protrusion completely disengages from the first recess, the first drawer disengages from the second drawer so that the second drawer can be moved forward individually when the door body continues to be pulled. On the one hand, the first drawer can be opened to facilitate the user's subsequent drawing of the first drawer; and on the other hand, the first drawer is only pulled out by a preset distance so that the user can check and access articles in the second drawer and/or third drawer below the first drawer. This facilitates the user's use and exhibits a simple structure, convenient manufacture and lower costs.

DETAILED DESCRIPTION

Figure 1:
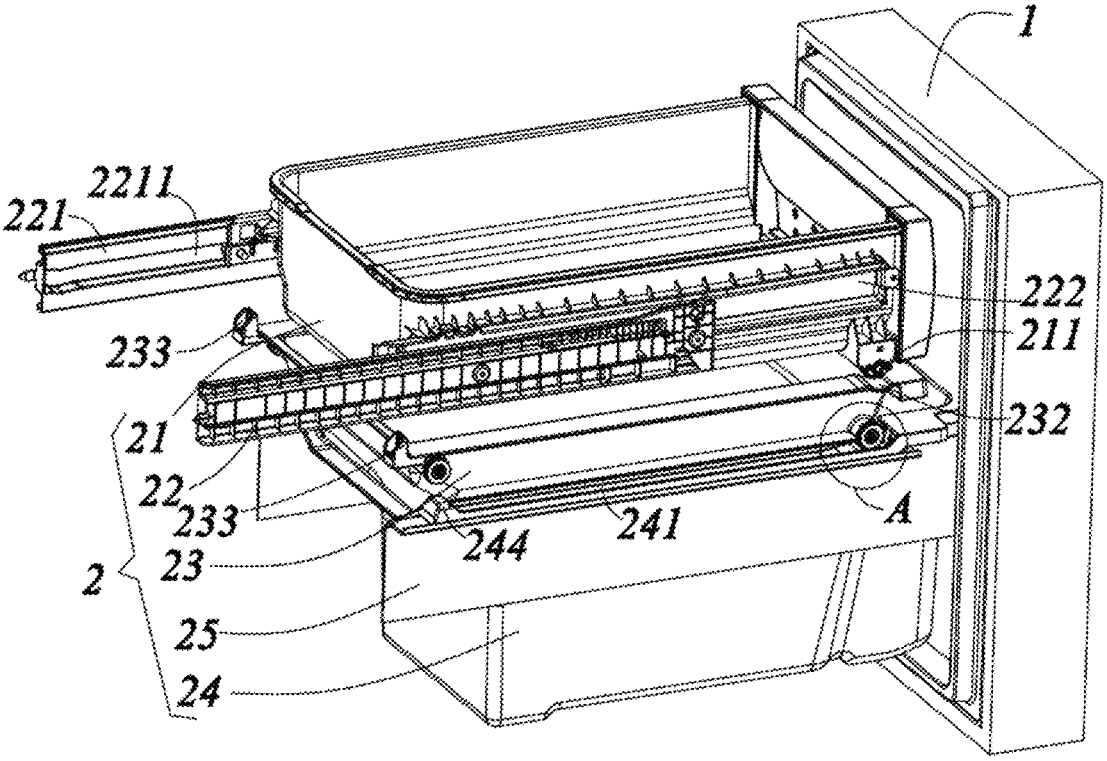
FIG. 1 is a structural schematic view of a door body and a drawer assembly in the present invention.
Figure 2:
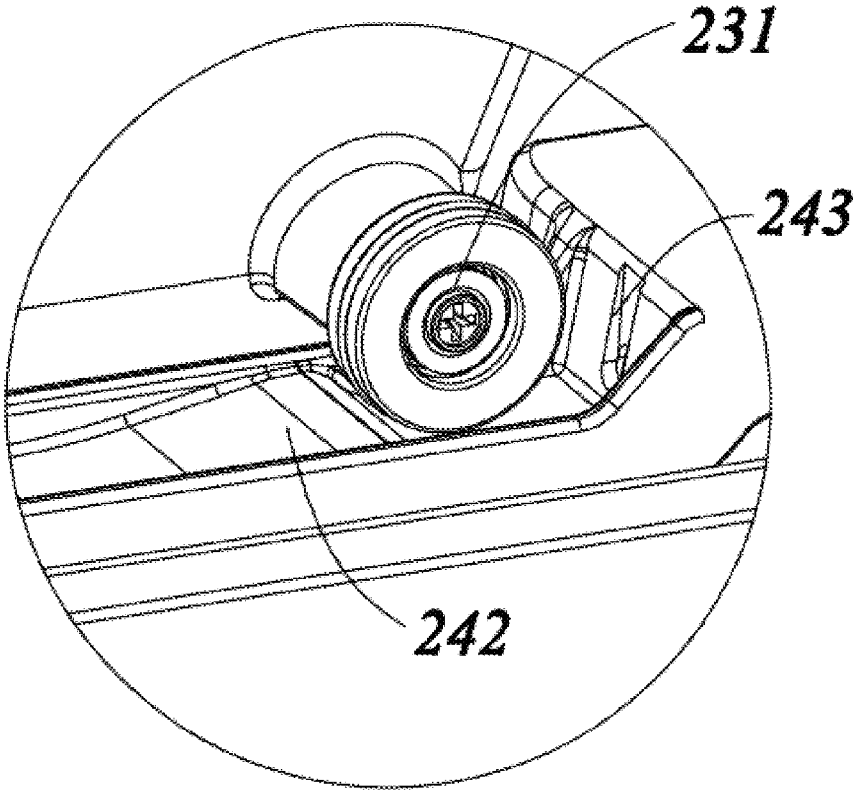
FIG. 2 is an enlarged structural schematic view of location A of FIG. 1.
Figure 3:
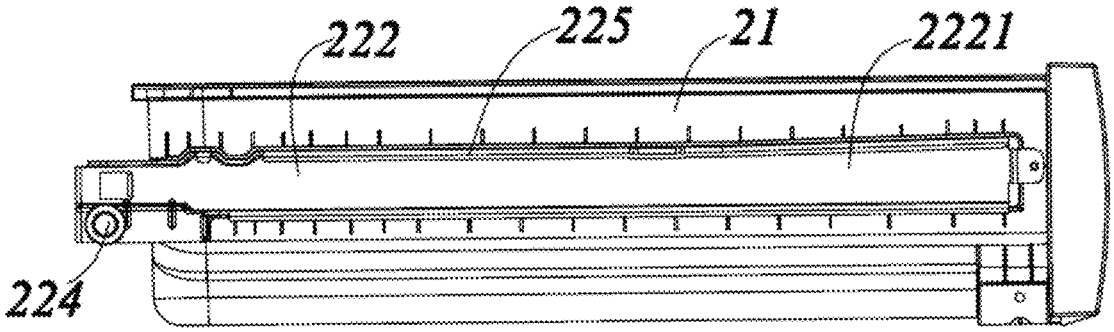
FIG. 3 is a structural schematic view of a first drawer having a slideway in FIG. 1.
Figure 4:
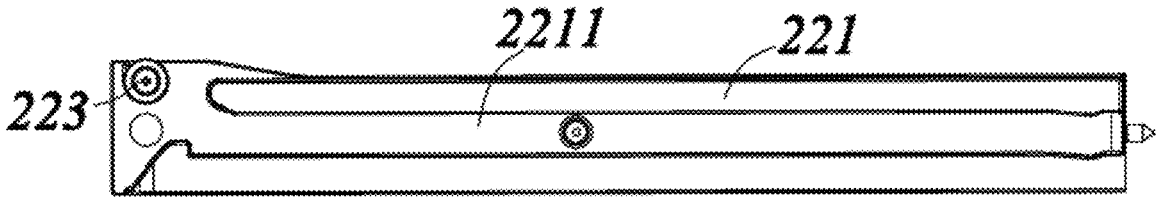
FIG. 4 is a structural schematic view of a guide rail of FIG. 1.

The present invention will be described in detail in conjunction with embodiments shown in figures. Reference is made to FIG. 1 through FIG. 4 which show preferred embodiments of the present invention.

In the description, it needs to be appreciated that unless otherwise definitely specified and limited, the term "connect" should be understood in a broad sense, for example, connect may be direct connect or indirect connect via an intermediate medium, or may be fixed connect or detachable connect or integral connect. Those having ordinary skill in the art may understand the specific meaning of the above term in the present invention according to specific situations.

In the description, when the refrigerator is used, a direction where the user lies is front, and a direction opposite thereto is rear.

Meanwhile, figures in the description only show a door body and a drawer assembly. Other structures are identical with those in conventional refrigerators and therefore not shown.

Referring to FIG. 1 through FIG. 4, the present invention provides a refrigerator comprising a cabinet having a storage chamber, a door body 1 slideably connected to the cabinet in a front-rear direction to open and close the storage chamber, and a drawer assembly 2 located in the storage chamber.

When the door body 1 closes the storage chamber, the door body 1 shields the drawer assembly 2 to prevent leakage of cold.

The drawer assembly 2 comprises a first drawer 21 slideably connected in the cabinet, a first slide rail assembly 22 slideably connecting the first drawer 21 to the cabinet in the front-rear direction, a second drawer 23 located below the first drawer 21, and a third drawer 24 located below the second drawer 23.

The third drawer 24 is connected to the door body 1 so that during opening or closing of the door body 1, the third drawer 24 moves synchronously with the door body 1, thereby implementing the opening and closing of the third drawer 24.

Specifically, the third drawer 24 is slideably connected to the cabinet through a lower slide rail assembly 25, the door body 1 is connected to the front end of the lower slide rail assembly 25 so that during opening or closing of the door body 1, the third drawer 24 moves synchronously with the door body 1, thereby implementing the opening and closing of the third drawer 24.

The third drawer 24 comprises a slide rail 241 disposed on an upper surface of opposed sidewalls of the third drawer 24, and a second recess disposed at a front end of the slide rail 241. The second drawer 23 is slideably connected to the cabinet, and the second drawer 23 comprises a second drawer body and a second roller 231 connected to an underside of the second drawer body and engaging with the slide rail 241; when the door body 1 is in a closed state, the second roller 231 is received in the second recess, so that when the door body 1 is pulled forward, the second recess pulls the second drawer 23 forward such that the second drawer 23 and the third drawer 24 move forward synchronously along with the door body 1 to simultaneously open the second drawer 23 and the third drawer 24.

Specifically, the third drawer 24 further comprises a first stop 242 protruding from the slide rail 241, and a second stop 243 protruding from the slide rail 241 and located in front of the first stop 242. The first stop 242, the second stop 243 and the slide rail 241 surround to form the second recess.

When the door body 1 is in a closed state, the second roller 231 is located between the first stop 242 and the second stop 243, so that when the door body 1 is pulled forward, the first stop 242 pulls the second drawer 23 forward such that the second drawer 23 and the third drawer 24 move forward synchronously to open the second drawer 23.

After the door body 1 is closed until the second roller 231 moves forward from the first stop 242 into the second recess, the second stop 243 stops the second roller 231 from continuing to move forward, i.e., stops the second drawer 23 from continuing to move forward to prevent the second drawer 23 from colliding with the door body 1 to generate a noise.

Furthermore, a first recess 232 is disposed at a front end of one of the upper surface of opposed sidewalls of the second drawer 23 and the underside of the first drawer 21, and a protrusion 211 engaging with the first recess 232 is disposed on the other. When the door body 1 is in a closed state, the protrusion 211 is located in the first recess 232 so that the door body 1, when pulled forward to bring the second drawer 23 to move forward, synchronously brings the first drawer 21 to move forward to open the first drawer 21.

Specifically, in the embodiment, the first recess 232 is a groove disposed at a front end of the upper surface of the opposed sidewalls of the second drawer 23, and the protrusion 211 is the first roller connected to the first drawer 21. When the door body is in a closed state, the first roller is located in the groove; when the door body 1 is opened, the groove engages with the first roller so that the second drawer 23 brings the first drawer 21 to move forward synchronously to open the first drawer 21; after the door body 1 is closed until the first roller is located in the groove, the first drawer 21 can be prevented from continuing to move forward to avoid colliding with the door body 1 to generate a noise.

Furthermore, the first slide rail assembly 22 comprises a guide rail 221 connected in to the interior of the cabinet and having a slide groove 2211, a slideway 222 disposed on the first drawer 21, a front roller 223 connected to a front end of the guide rail 221 and engaging with the slideway 222, and a rear roller 224 connected to a rear end of the slideway 222 and engaging with the slide groove 2211, so that the front and rear of the first drawer 21 are connected to the cabinet to facilitate the opening and closing of the first drawer 21.

Specifically, the first slide rail assembly 22 further comprises a slideway plate 225 connected to the first drawer 21, the slideway 222 being formed by bending the slideway plate 225, to enhance universality of the first slide rail assembly 22.

The slideway plate 225 is a sheet metal plate.

Furthermore, at the front end of the slideway 222 is provided an inclined portion 2221 extending obliquely upward from rear to front. While the door body 1, pulled forward, brings the first drawer 21 to move forward, the front roller 223 moves along the inclined portion 2221, and the first drawer 21 synchronously moves upward while moving forward, so that the protrusion 211 gradually disengages from the first recess 232; after the protrusion 211 completely disengages from the first recess 232, the first drawer 21 disengages from the second drawer 23 so that the second drawer moves forward individually. The first drawer 21 is only pulled forward by a preset distance so that on the one hand, the first drawer 21 can be opened to facilitate the user's subsequent drawing of the first drawer 21; and on the other hand, the user can view and access articles in the second drawer 23 and/or third drawer 24 below the first drawer 21. This facilitates the user's use and exhibits a simple structure, convenient manufacture and lower costs.

Meanwhile, the slideway 222 comprises an upper edge and a lower edge opposed to each other and spaced apart from each other, the upper edge corresponding to the inclined portion 2221 extends obliquely forward from rear to front, whereas the lower edge extends rectilinearly from rear to front. Under the action of gravitational force of the first drawer 21, the first roller 223 moves along the upper edge of the slideway 222, so the first drawer 21 is enabled to move upward and forward while the front roller 223 moves along the upper edge corresponding to the inclined portion 2221.

Furthermore, the second drawer 23 further comprises a third stop 233 disposed at a rear end of the second drawer 23 and protruding upward; a fourth stop cooperating with the third stop 233 is disposed protrusively on the cabinet; after the door body 1 is pulled forward so that the third drawer 24 brings the second drawer 23 to move forward by a preset distance, the third stop 233 cooperates with the fourth stop to prevent the second drawer 23 from continuing to move forward; the door body 1 is further pulled forward so that the second roller 231 disengages rearward from the first stop 2242, thereby making it possible to move the second drawer 23 forward by a preset distance and individually continue to open the third drawer 24 forward to facilitate the user to check articles in the respective drawers and facilitate the user's use.

Meanwhile, after the second roller 231 disengages backward from the first stop 242, the second drawer 23 can move back and forth along the slide rail 241 to control the opening size of the second drawer 23.

Furthermore, a fifth stop 244 protruding upward is further provided at the rear end of the slide rail 241 to limit the backward movement distance of the second drawer 23, and prevent the second drawer 23 from the third drawer 24 from the rear end.

The fourth stop is located at a position forwards of the cabinet. It may be appreciated that a stroke that the second drawer 23 brings the first drawer 21 to move forward is smaller than a stroke that the third drawer 24 brings the second drawer 23 to move forward. After the door body 1 is opened to a maximum position, the first drawer 21 is opened to a minimum degree, the second drawer 23 comes next and the third drawer 24 is opened to a maximum degree, so that the user can check articles in respective drawers and the user can draw respective drawers conveniently.

To conclude, the first recess 232 is disposed on one of the second drawer 23 and first drawer 21 of the refrigerator according to the present invention, and the protrusion 211 engaging with the first recess is disposed on the other; meanwhile, the inclined portion 2221 is disposed at the front end of the slideway 222; while the door body 1 is pulled forward so that the second drawer 23 brings the first drawer 21 to move forward synchronously, the front roller 223 moves along the inclined portion 2221, and the first drawer 21 synchronously moves upward while moving forward, so that the protrusion 211 gradually disengages from the first recess 232; after the protrusion 211 completely disengages from the first recess 232, the first drawer 21 disengages from the second drawer 23 so that the second drawer 23 can be moved forward individually when the door body 1 continues to be pulled. On the one hand, the first drawer 21 can be opened to facilitate the user's subsequent drawing of the first drawer 21; and on the other hand, the first drawer 21 is only pulled out by a preset distance so that the user can check and access articles in the second drawer 23 and/or third drawer 24 below the first drawer 21. This facilitates the user's use and exhibits a simple structure, convenient manufacture and lower costs.

It should be understood that although the description is described according to the embodiments, not every embodiment only includes one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A refrigerator, comprising a cabinet having a storage chamber, a door body slideably connected to the cabinet in a front-rear direction to open and close the storage chamber, and a drawer assembly located in the storage chamber, the drawer assembly comprising a first drawer, a first slide rail assembly slideably connecting the first drawer to an interior of the cabinet, a second drawer slideably connected to the interior of the cabinet and located below the first drawer, the second drawer being capable of moving forward along with the door body, wherein a first recess is disposed at a front end of one of an upper surface of opposed sidewalls of the second drawer and an underside of the first drawer, and a protrusion engaging with the first recess is disposed on the other; the first slide rail assembly comprises a guide rail connected in to the interior of the cabinet and having a slide groove, a slideway disposed on the first drawer, a front roller connected to a front end of the guide rail and engaging with the slideway, and a rear roller connected to a rear end of the slideway and engaging with the slide groove, the front end of the slideway being provided with an inclined portion extending obliquely upward from rear to front.

2. The refrigerator according to claim 1, wherein the first recess is a groove disposed at a front end of the upper surface of the opposed sidewalls of the second drawer, and the protrusion is a first roller connected to the first drawer.

3. The refrigerator according to claim 1, wherein the first slide rail assembly further comprises a slideway plate connected to the first drawer and extending in a front-rear direction, the slideway being formed by bending the slideway plate.

4. The refrigerator according to claim 1, wherein the slideway comprises an upper edge and a lower edge, the upper edge corresponding to the inclined portion extending obliquely forward from rear to front.

5. The refrigerator according to claim 1, wherein the drawer assembly further comprises a third drawer connected to the door body and located below the second drawer, the third drawer being slideably connected to the cabinet; the third drawer comprises a slide rail disposed on an upper surface of opposed sidewalls of the third drawer, and a second recess disposed at a front end of the slide rail; the second drawer comprises a second drawer body and a second roller connected to an underside of the second drawer body and engaging with the slide rail, the second roller being located in the second recess when the door body is in a closed state.

6. The refrigerator according to claim 5, wherein the third drawer further comprises a first stop protrusively disposed on the slide rail, and a second stop protrusively disposed on the slide rail and located in front of the first stop, and wherein the first stop, the second stop and the slide rail surround to form the second recess.

7. The refrigerator according to claim 5, wherein the second drawer further comprises a third stop disposed at a rear end of the second drawer body and protruding upward, and a fourth stop cooperating with the third stop is disposed on the cabinet to limit a forward movement distance of the second drawer.

8. The refrigerator according to claim 5, wherein the third drawer further comprises a fifth stop disposed at the rear end of the slide rail and protruding upward.

* * * * *